US006779993B2

(12) United States Patent
Kim et al.

(10) Patent No.: US 6,779,993 B2
(45) Date of Patent: Aug. 24, 2004

(54) ROTOR PROFILE FOR SCREW COMPRESSORS

(75) Inventors: Jeong Suk Kim, Inchon (KR); Jae Ho Lee, Seoul (KR)

(73) Assignee: Jae Young Lee, Seoul (KR)

( * ) Notice: Subject to any disclaimer, the term of this patent is extended or adjusted under 35 U.S.C. 154(b) by 0 days.

(21) Appl. No.: 10/348,868

(22) Filed: Jan. 22, 2003

(65) Prior Publication Data

US 2003/0170135 A1 Sep. 11, 2003

(30) Foreign Application Priority Data

Jan. 25, 2002 (KR) ..... 10-2002-0004508

(51) Int. Cl.[7] ..... F04C 18/16
(52) U.S. Cl. ..... 418/201.3
(58) Field of Search ..... 418/201.3

(56) References Cited

U.S. PATENT DOCUMENTS 4,412,796 A 11/1983 Bowman ..... 418/201.3
4,890,991 A * 1/1990 Yoshimura ..... 418/201.3
5,624,250 A * 4/1997 Son ..... 418/201.3

FOREIGN PATENT DOCUMENTS

GB 1197432 7/1970
GB 2092676 8/1982
KR 10 1997 0122515 9/1997

* cited by examiner

*Primary Examiner*—John J. Vrablik
(74) *Attorney, Agent, or Firm*—Knoble Yoshida & Dunleavy, LLC

(57) ABSTRACT

A rotor profile for screw compressors is disclosed. The rotor profile is shown in a latitudinal cross-section taken along a line extending in a direction perpendicular to rotor axes, and is applied to male and female rotors used in a screw compressor having a housing defining an actuating space therein, the male rotor being rotatably set in the actuating space and having spiral teeth and roots defined between the teeth, and the female rotor being set in the actuating space to rotatably engage with the male rotor and having spiral teeth and roots defined between the teeth. The rotor profile comprises a first curve F-G determined as a circular arc and inscribed in an addendum circle of the female rotor at a point "G" around a trailing end of each tooth of the female rotor, and a second curve determined by a hyperbola function $r=(\epsilon \cdot K)/(1-\epsilon \cdot \cos\theta)$, wherein $1.1 \leqq \epsilon \leqq 1.15$, and a derived function of first order of the hyperbola function of the second curve at a point "F" is equal to a derived function of first order of a function of the curve F-G. Due to the curve E-F, the blow-hole size is preferably minimized while the pressure angle of a rotor machining tool is maintained at a level of at least 8°. In addition, due to an appropriately limited wrap angle of the male rotor, the pressure angle of the rotor machining tool is increased and desired tooth strength is maintained.

4 Claims, 10 Drawing Sheets

$0 <= \theta <= 180$ deg

ROTOR PROFILE FOR SCREW COMPRESSORS

BACKGROUND OF THE INVENTION

1. Field of the Invention

The present invention relates, in general, to screw compressors which have a pair of rotors and are used for compressing gas to increase the gas pressure and, more particularly, to a rotor profile for such screw compressors, which is designed to minimize the cross-sectional area of a blow-hole while increasing the minimum pressure angle of a rotor machining tool.

2. Description of the Prior Art

In a screw compressor, a pair of rotors, that is, male and female rotors, are set in the actuating space of a compressor housing while engaging with each other and being supported by bearings, such that the two rotors are rotated relative to each other to gradually reduce the volumes of the compression chambers sealed by the rotors and the compressor housing, thus compressing gas inside the chambers. In the screw compressor, the important parts of the teeth of the female rotor are positioned inside the pitch circle thereof, while the important parts of the teeth of the male rotor are positioned outside the pitch circle thereof. Degree of precision and shapes of male and female rotors typically determine performance of screw compressors, for example, displacement and volumetric efficiency. In a detailed description, in terms of the shapes of the rotors, the performance of the screw compressors is typically determined by the length of a seal line and the cross-sectional area of a blow-hole such that the performance is enhanced in accordance with a reduction of both the length of the seal line and the cross-sectional area of the blow-hole. Shapes of rotors for screw compressors have been actively studied in recent years, and many patent applications for the rotor shapes have been filed in many countries. However, in accordance with performance tests for screw compressors having the above-mentioned rotors, small pressure angles of rotor machining tools used in the process of producing the rotors degrade the performance of resulting screw compressors more seriously than long seal lines or large-sized blow-holes. That is, when the rotor machining tools have small pressure angles, the tools may fail to machine precise rotors, so that it is almost impossible to assemble the rotors in the housing of a screw compressor, or the tools may cause large machining errors in the produced rotors due to the portions of the tools having the small pressure angles, thus resulting in an increase in the leakage of gas through the parts of the rotors having the large machining errors and degrading operational efficiency of the screw compressors.

Examples of conventional rotor profiles for screw compressors may be referred to U.S. Pat. No. 4,412,796, UK Patent Nos. 1197432 and 2092676. The rotors disclosed in the above three patents have asymmetric rotor profiles different from conventional symmetric rotor profiles, so that the compressor performance is enhanced. In the rotor profiles disclosed in U.S. Pat. No. 4,412,796 and UK Patent No. 2092676, the addendum of a female rotor is designed to be relatively large in comparison with the outer diameter of the female rotor and the dedendum of a male rotor engaging with the female rotor is designed to be relatively large in comparison with the outer diameter of the male rotor, so that the volume of the actuating space of a compressor housing is preferably increased. However, the above rotor profiles undesirably increase the blow-hole sizes, thus reducing volumetric efficiency and adiabatic efficiency of resulting compressors. Definition of the technical term "blow-hole" is described as follows with reference to FIGS. 1 and 2. That is, the curve F-G of each female rotor tooth defined at a position around a trailing end of the female rotor tooth is designed to have a constant curvature. Therefore, when the male and female rotors are rotated after the point "F" of a female rotor tooth comes into contact with the point "f" of a male rotor tooth, the two rotors are not kept in contact with each other, but are separated from each other. At this time, a three-dimensional space is defined between the compressor housing and the two rotors, thus causing leakage of gas from a high-pressure chamber into a low-pressure chamber inside the housing. The above-mentioned three-dimensional space having a triangular cross-section is known as a so-called "blow-hole" in the technical field. In an effort to minimize the size of the blow-hole, the female rotor profile may be designed to remove the curve F-G from each female rotor tooth, and, at the same time, the male rotor profile may be designed to extend the curve D-E, generated by the male rotor, to an addendum circle of the female rotor, thus completely preventing formation of the blow-hole between the rotors, and the housing. In such a case, the blow-hole size becomes zero, and it is possible to ideally prevent leakage of gas from the high-pressure chamber into the low-pressure chamber. However, unfortunately, it is impossible to practically produce male and female rotors having the above-mentioned rotor profile.

In addition, in terms of workability and production cost regarded as very important factors determining productivity of rotors for screw compressors, the rotor profile disclosed in UK Patent No. 1197432 has a portion with a pressure angle of zero, thus undesirably causing severe frictional wear of rotor machining tools while producing rotors and resulting in difficulty in precise machining of the rotors. The rotor profiles disclosed in UK Patent No. 1197432 and U.S. Pat. No. 4,412,796 result in formation of point-generated portions around the trailing ends of the rotor teeth, so that it is very difficult to machine the rotors and the point-generated portions of the rotor teeth are severely worn due to friction. The point-generated portions of the rotor teeth thus result in severe damage to the rotors, and reduce the expected life span of the screw compressors. Furthermore, the pointed-generated portions of the rotor teeth shorten the expected life span of bearings and filters used in the screw compressors.

In an effort to overcome the above-mentioned problems, Korean patent Laid-open Publication No. 95-27198 proposes a rotor profile for screw compressors. As shown in FIG. 9, the rotor profile disclosed in the above Korean patent, includes both a curve d2–c2 generated by a portion of the male rotor's tooth profile defined by an optimum quadratic function, $f(x)=ax^2+bx+c$, and a circular arc c2–b2, so that it is possible to desirably reduce a vacuum space in a compressor and converge the slip coefficient at drive parts of rotors to zero. However, the above rotor profile is disadvantageous in that the radius of curvature of a curve a2–b2 generated at a portion around the trailing end of each of the female rotor teeth is excessively reduced to degrade productivity of rotors and fails to improve operational efficiency of a screw compressor, even though the reduced radius of curvature of the curve generated at the trailing end of each female rotor tooth somewhat reduces the size of a blow-hole to enhance the operational efficiency of the screw compressor. That is, the reduced radius of curvature of the curve generated at the trailing end of each female rotor tooth undesirably reduces the pressure angle of a rotor machining tool to 5°, thus resulting in excessive errors on produced rotors and thereby downgrading productivity of the rotors and failing to improve operational efficiency of screw compressors. In the rotor profile disclosed in the above Korean patent, the curve c2–b2 of the female rotor tooth defining the blow-hole is a circular arc, so that the reduction of the size of the blow-hole is not sufficient. A screw compressor having the above rotor profile is advantageous in that the rotors have a tooth ratio of 4:5 (numbers of male and female rotor teeth: 4+5) capable of preferably reducing the rotor machining time and saving the material of rotors because it is possible to produce the rotors using small-sized materials. However, the rotor profile is problematic in that it excessively reduces the diameter of a drive rotor and does not allow a desired increase in the size of bearings, and often causes the severe problem of an excessive reduction of axial strength of rotors under high-pressure operating conditions.

SUMMARY OF THE INVENTION

Accordingly, the present invention has been made keeping in mind the above problems occurring in the prior art, and an object of the present invention is to provide a rotor profile for screw compressors, which determines a curve positioned around the trailing end of each of female rotor teeth by using a hyperbola function capable of increasing the minimum pressure angle of a rotor machining tool, thus minimizing the cross-sectional area of a blow-hole while allowing the rotor machining tool to desirably produce precise rotors under agreeable machining conditions.

Another object of the present invention is to provide a rotor profile for screw compressors, which is designed to optimize the wrap angles of rotors, thus increasing the minimum pressure angle of a rotor machining tool while maintaining desired strengths of the rotors.

A further object of the present invention is to provide a rotor profile for screw compressors, which is designed to use a female rotor as a drive rotor, thus minimizing leakage of gas from a high-pressure chamber into a low-pressure chamber, and which has a tooth ratio of 4:6 (numbers of male and female rotor teeth: 4+6), thus enhancing the axial strength of rotors under high-pressure operating conditions and improving workability during a process of machining rotors, and providing rotors having improved performance.

In order to accomplish the above objects, the present invention provides a rotor profile for screw compressors, which is shown in a latitudinal cross-section taken along a line extending in a direction perpendicular to rotor axes and applied to male and female rotors used in a screw compressor having a housing defining an actuating space therein, the male rotor being rotatably set in the actuating space and having spiral teeth and roots defined between the teeth, and the female rotor being set in the actuating space to rotatably engage with the male rotor and having spiral teeth and roots defined between the teeth, the rotor profile comprising: a first curve F-G determined as a circular arc and inscribed in an addendum circle of the female rotor at a point "G" around a trailing end of each tooth of the female rotor; and a second curve determined by a hyperbola function $r=(\epsilon\cdot K)/(1-\epsilon\cdot\cos\theta)$, wherein $1.1\leqq\epsilon\leqq1.15$, and a derived function of first order of the hyperbola function of the second curve at a point "F" is equal to a derived function of first order of a function of the curve F-G. In the rotor profile, the male rotor has a wrap angle larger than 300° and not larger than 310°.

In the rotor profile, the male rotor has a male rotor profile with curves a-b, b-c, c-d, d-e, e-f, f-g and g-a, and the female rotor has a female rotor profile with curves A-B, B-C, C-D, D-E, E-F, F-G and G-A. In the male rotor profile, the curve a-b is a generated curve which is generated by the curve A-B of the female rotor; the curve b-c is a generated curve which is generated by the curve B-C of the female rotor; the curve c-d is a generated curve which is generated by the curve C-D of the female rotor; the curve d-e is a circular arc which is inscribed in an addendum circle of the male rotor and has a center of curvature on a line extending between centers of the male and female rotors; the curve e-f is a generated curve which is generated by the curve E-F of the female rotor; the curve f-g is a generated curve which is generated by the curve F-G of the female rotor; and the curve g-a is a circular arc which is defined along a dedendum circle of the male rotor and has a center "0 m" of curvature at the center of the male rotor. In the female rotor profile, the curve A-B is a circular arc which is inscribed in the addendum circle "Af" of the female rotor at a point "A", is circumscribed on the curve B-C at a point "B" and has a center "01" of curvature; the curve B-C is a circular arc which is circumscribed on the curve A-B at the point "A", is circumscribed on the curve C-D at a point "C", and has a center "02" of curvature; the curve C-D is a circular arc which is circumscribed on the curve B-C at the point "C", and is inscribed in the addendum circle "Am" of the male rotor at point "D", and has a center "03" of curvature on the line extending between the centers of the male and female rotors; the curve D-E is a generated curve which is generated by the curve d-e of the male rotor; the curve E-F is a curve determined by the hyperbola function $r=(\epsilon\cdot K)/(1-\epsilon\cdot\cos\theta)$, wherein $1.1\leqq\epsilon\leqq1.15$, $\theta$ is a variable, a derived function of first order of the hyperbola function of the curve E-F at a point "E" is equal to a derived function of first order of a function of the curve D-E, and a derived function of first order of the hyperbola function of the curve E-F at the point "F" is equal to the derived function of first order of the function of the curve F-G; the curve F-G is the circular arc which is inscribed in the addendum circle of the female rotor, and the derived function of first order of the function of which at the point F is equal to the derived function of first order of the hyperbola function of the curve E-F; and the curve G-A is a circular arc which is defined along the addendum circle of the female rotor and has a center of curvature at the center "0f" of the female rotor.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
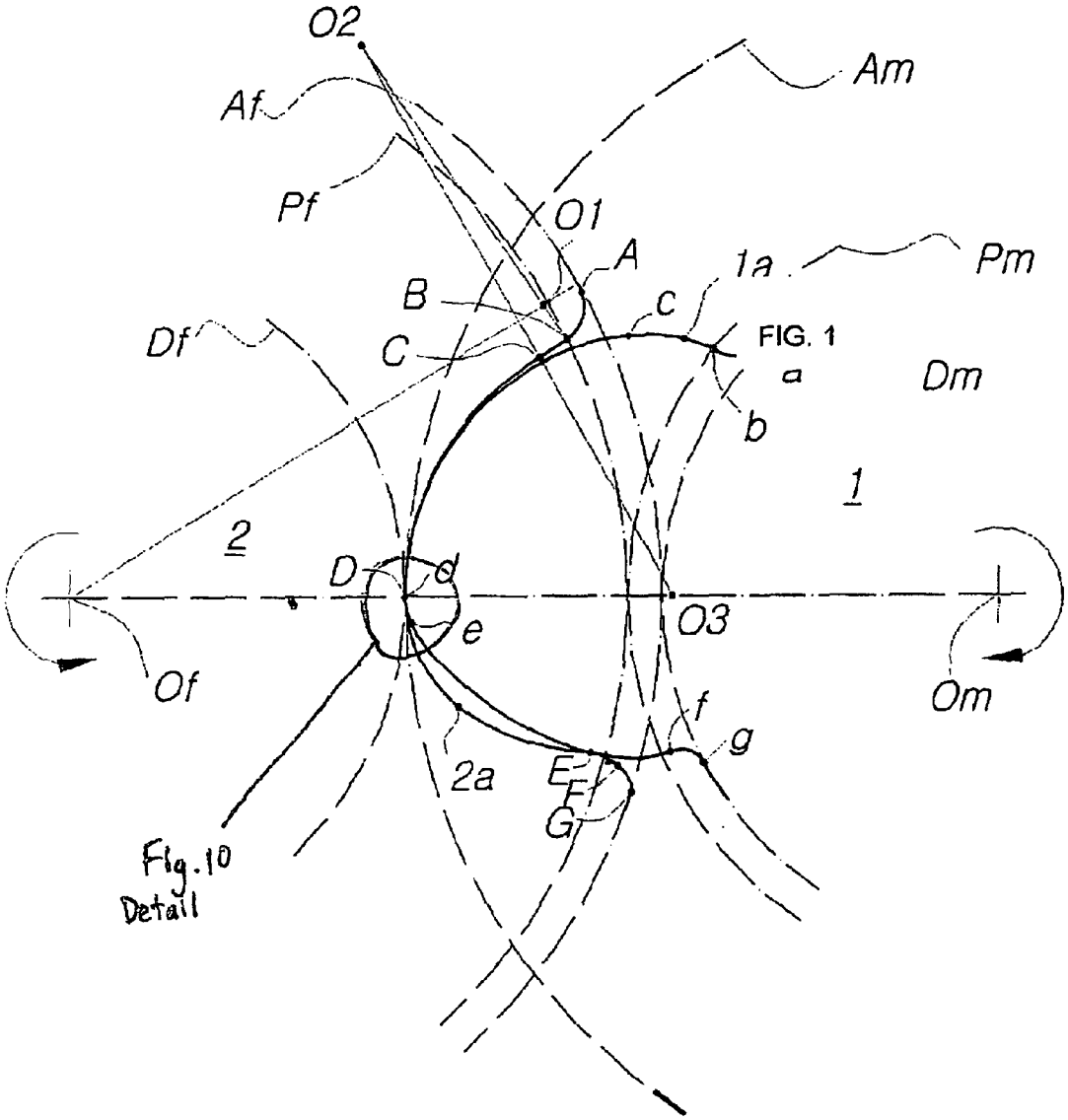
FIG. 1 is a sectional view showing a rotor profile for screw compressors in accordance with an embodiment of the present invention.
Figure 2:
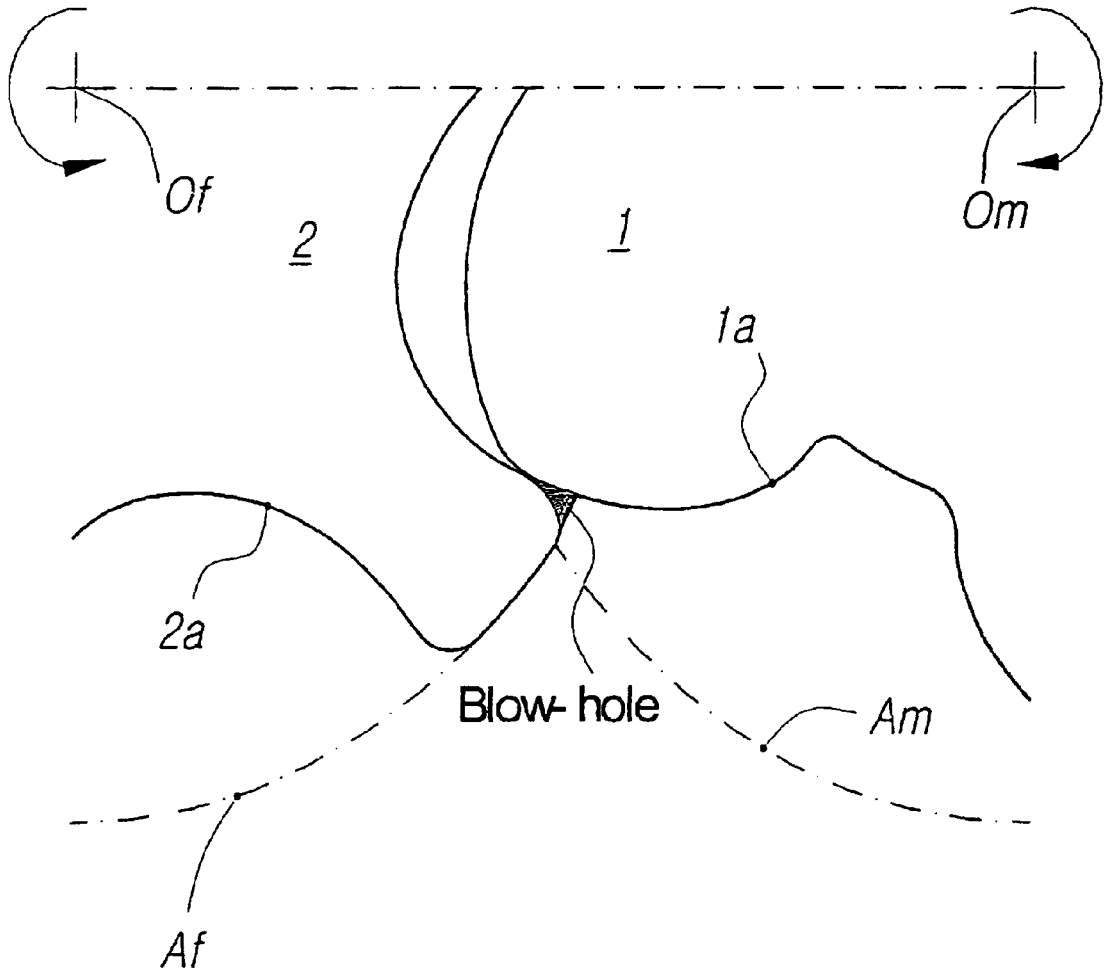
FIG. 2 is a sectional view showing a blow-hole defined between a compressor housing and male and female rotors of FIG. 1.

Reference should now be made to the drawings, in which the same reference numerals are used throughout the different drawings to designate the same or similar components.

FIG. 1 shows a rotor profile for screw compressors in a latitudinal cross-section taken along a line extending in a direction perpendicular to rotor axes. As shown in the drawing, a rotor assembly according to the present invention comprises male and female rotors 1 and 2, set in a compressor housing (not shown) while rotatably engaging with each other. The male and female rotors 1 and 2 have a plurality of teeth 1*a* and 2*a*, respectively. In the preferred embodiment of the present invention, the female rotor 2 is used as a drive rotor, and the male rotor 1 is used as a driven rotor. The number of the teeth 2*a* of the female rotor 2 is preferably set to six, and the number of the teeth 1*a* of the male rotor 1 is preferably set to four, thus accomplishing a tooth ratio of 4:6 (numbers of male and female rotor teeth: 4+6). Due to the above-mentioned tooth ratio of 4:6, it is possible to enhance the axial strength of the rotors under high-pressure operating conditions and improve workability during a process of machining the rotors. In the technical field, the teeth of male and female rotors are called "lands".

Each tooth 1*a* of the male rotor 1 has a profile with curves a-b, b-c, c-d, d-e, e-f, f-g and g-a which are sequentially positioned along the profile of the tooth 1*a* in a direction from the leading end to the trailing end of the tooth 1*a*. The above-mentioned curves a-b, b-c, c-d, d-e, e-f, f-g and g-a are defined as follows:

1) The curve a-b is a generated curve, generated by a curve A-B of each female rotor tooth 2*a*.
2) The curve b-c is a generated curve, generated by a curve B-C of the female rotor tooth 2*a*.
3) The curve c-d is a generated curve, generated by a curve C-D of the female rotor tooth 2*a*.
4) The curve d-e is a circular arc which is inscribed in an addendum circle "Am" of the male rotor teeth 1*a* and has a center of curvature on a line extending between the centers "0 m" and "0f" of the male and female rotors 1 and 2.
5) The curve e-f is a generated curve, generated by a curve E-F of the female rotor tooth 2*a*.
6) The curve f-g is a generated curve, generated by a curve F-G of the female rotor tooth 2*a*.
7) The curve g-a is a circular arc which is defined along a dedendum circle "Dm" of the male rotor teeth 1*a* and has a center of curvature at the center "0 m" of the male rotor 1.

Each tooth 2*a* of the female rotor 2 has a profile with the curves A-B, B-C, C-D, D-E, E-F, F-G and G-A which are sequentially positioned along the profile of the tooth 2*a* in a direction from the leading end to the trailing end of the tooth 2*a*. The above-mentioned curves A-B, B-C, C-D, D-E, E-F, F-G and G-A are defined as follows:

8) The curve A-B is a circular arc.
9) The curve B-C is a circular arc.
10) The curve C-D is a circular arc.
11) The curve D-E is a generated curve, generated by the curve d-e of the male rotor tooth 1*a*.
12) The curve E-F is a curve determined by a hyperbola function $r=(\epsilon\cdot K)/(1-\epsilon\cos\theta)$, wherein $1.1\leqq\epsilon\leqq1.15$, K=6, θ is a variable, a derived function of first order of the hyperbola function of the curve E-F at a point E is equal to a derived function of first order of a function of the curve D-E, and a derived function of first order of the hyperbola function of the curve E-F at a point F is equal to a derived function of first order of a function of the curve F-G.
13) The curve F-C is a circular arc.
14) The curve G-A is a circular arc which is defined along an addendum circle "Af" of the female rotor teeth 2*a* and has a center of curvature at the center "0f"of the female rotor 2.

The operational effect of the male and female rotors 1 and 2 having the above-mentioned rotor profile is as follows. In each tooth 2*a* of the female rotor 2, the curve E-F positioned around the trailing end of the tooth 2*a* is determined by the hyperbola function, $r=(\epsilon\cdot K)/(1-\epsilon\cos\theta)$, which is defined in the graph of FIG. 3 and freely changes the curvature of the curve E-F as desired. Therefore, it is possible to easily adjust the size of a blow-hole and the pressure angle of a rotor machining tool for the rotors, so that a desired rotor profile capable of increasing the minimum pressure angle of the rotor machining tool and minimizing the size of the blow-hole is preferably generated. In such a case, the minimum pressure angle of the rotor machining tool is set to 8°, the operational effect of minimizing the blow-hole is shown in FIGS. 4 to 6.

Figure 3:
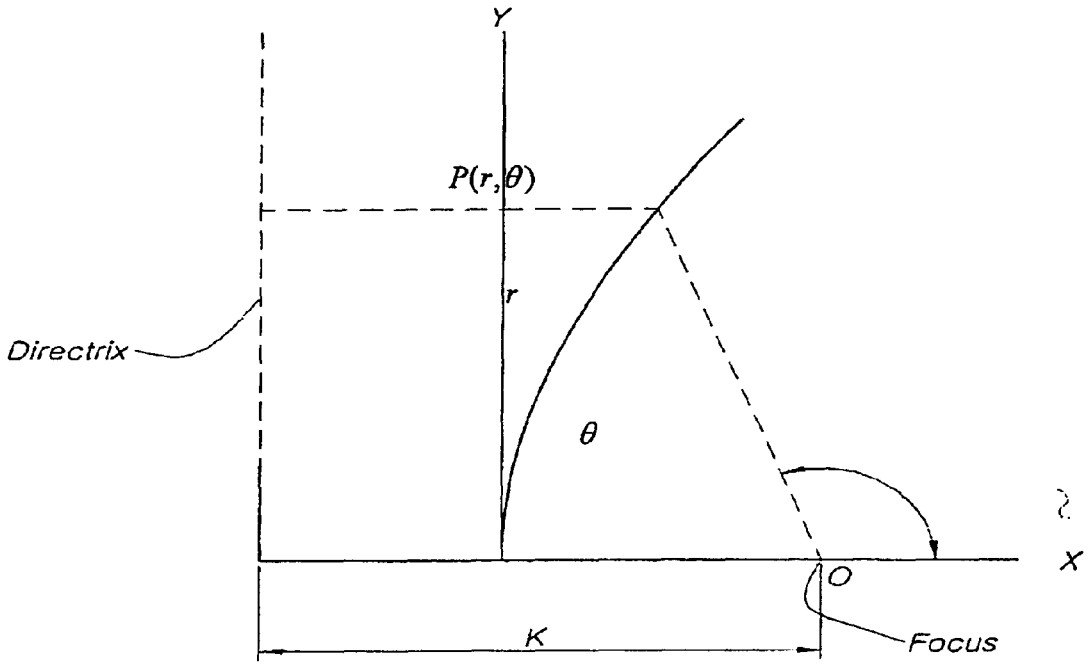
FIG. 3 is a graph defining a hyperbola function determining a curve E-F of the female rotor of FIG. 1.
Figure 4:
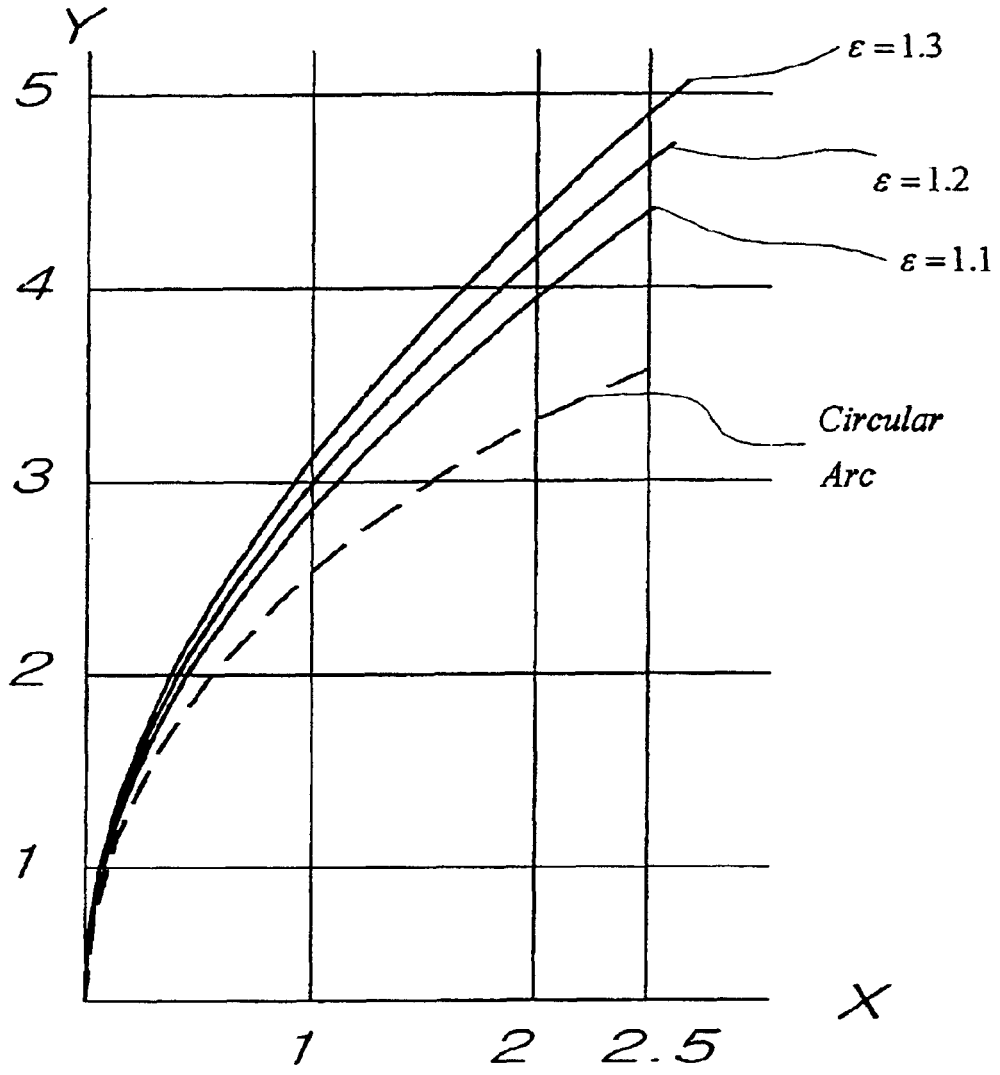
FIG. 4 is a graph showing a difference between a circular arc and various curves differently determined in accordance with a variation in a parameter "$\epsilon$" in the hyperbola function defined by the graph of FIG. 3.

FIG. 4 is a graph showing characteristics of a circular arc and various curves differently determined in accordance with a variation in the parameter "ϵ" in the hyperbola function defined by the graph of FIG. 3. Once a radius of a circular arc is determined, the curvature of the circular arc becomes a fixed constant, so that it is impossible to change the curvature of the circular arc. Therefore, it is almost impossible to freely generate a desired rotor profile for screw compressors by using only the circular arcs. However, it is possible to freely generate a desired rotor profile for screw rotors by using the hyperbola function $r=(\epsilon\cdot K)/(1-\epsilon\cdot\cos\theta)$ according to the present invention. That is, when the radius "Rm" of the dedendum circle "Dm" of the male rotor for screw compressors is set to 51, that is, Rm=51, a desired rotor profile is freely generated by the hyperbola function $r=(\epsilon\cdot K)/(1-\cdot\cos\theta)$, wherein K is preferably set to a constant, θ is a variable determining the specific forms of curves and is preferably set to $90°\leqq\theta\leqq180°$, and ϵ is variously changed to, for example, 1.1, 1.2 or 1.3.

Figure 5:
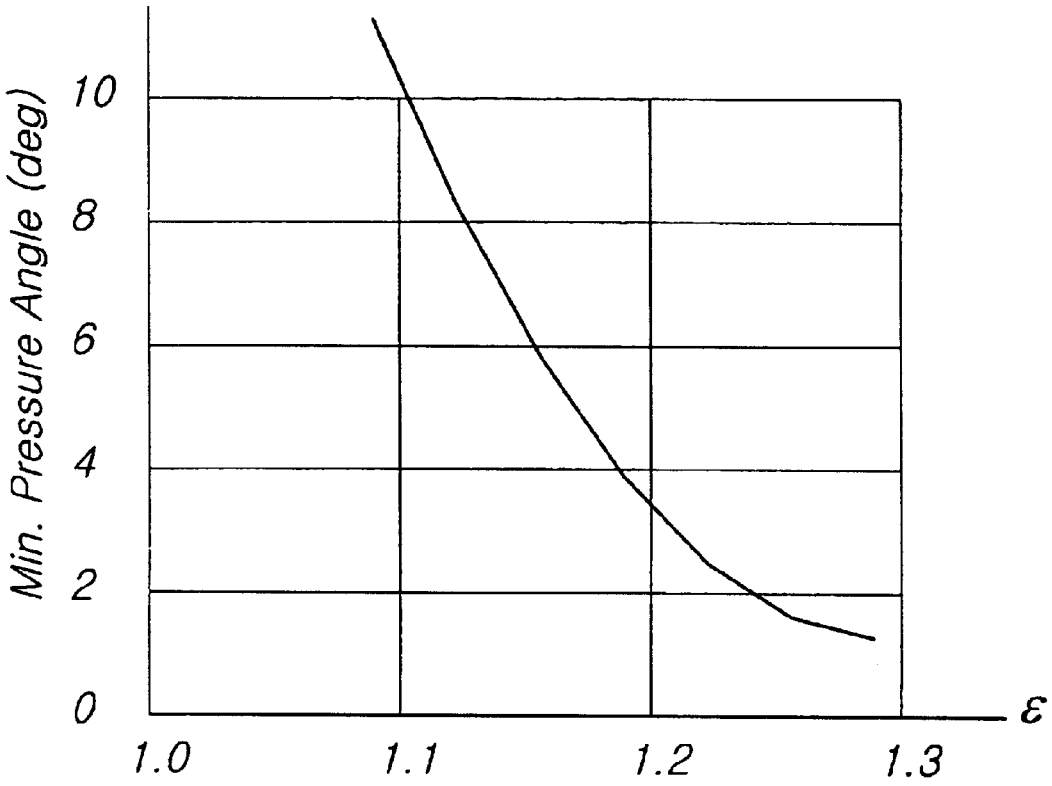
FIG. 5 is a graph showing a variation in the minimum pressure angle of the female rotor in accordance with a variation in the parameter "$\epsilon$" in the hyperbola function determining the curve E-F of the female rotor of FIG. 1.

FIG. 5 is a graph showing a variation in the minimum pressure angle of the female rotor 2 in accordance with a variation in the parameter "ϵ" in the hyperbola function $r=(\epsilon\cdot K)/(1-\epsilon\cdot\cos\theta)$ determining the curve E-F of each tooth 2*a* of the female rotor 2. In such a case, the minimum pressure angle of the female rotor 2 is equal to the minimum pressure angle of a rotor machine tool for the female rotor 2. In the graph of FIG. 5, the parameter "ϵ" varies between 1.0 and 1.4. When the radius "Rm" of the dedendum circle "Dm" of the male rotor for screw compressors is set to 51, that is, Rm=51, and the parameter "ϵ" is set to be less than 1.15, the minimum pressure angle of the female rotor 2 is set to 8°. In a rotor profile for screw compressors, the minimum pressure angle typically belongs to a female rotor rather than a male rotor. Therefore, it is possible to produce a desired rotor profile for screw compressors by determining the parameter "$\epsilon$" such that the minimum pressure angle of the female rotor 2 is set to 8°. When the minimum pressure angle of the female rotor 2 is set to 8°, the machining errors generated in the produced rotors due to the pressure angle during a process of cutting or dressing the rotor teeth are desirably reduced. In recent years, a dressing process is preferred over a cutting process to produce rotor teeth. In a detailed description, the rotor teeth are preferably produced through a dressing process, wherein a raw material is dressed by using a diamond dresser to produce a rotor machining tool, and the desired rotor teeth is produced by using the rotor machining tool. In such a case, when determining the minimum of the rotor machining tool not smaller than 8°, a raw material is effectively and precisely dressed to produce a rotor machining tool, and so it is possible to increase the precision of the rotor machining tool and produce a precise rotor profile by using the machining tool.

Figure 6:
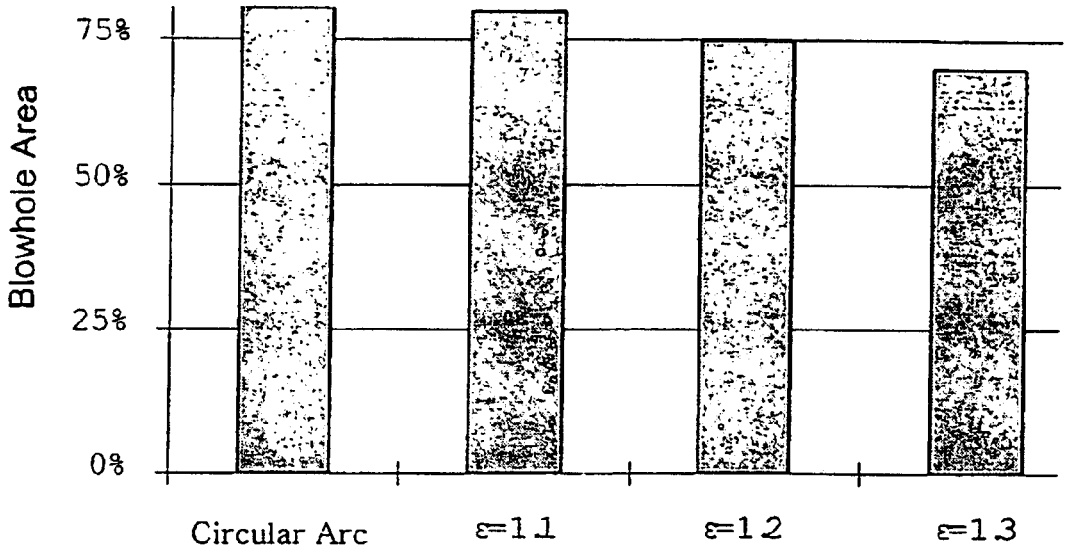
FIG. 6 is a graph showing a variation in the cross-sectional area of a blow-hole in accordance with a variation in the parameter "$\epsilon$" in the hyperbola function determining the curve E-F of the female rotor of FIG. 1.

FIG. 6 is a graph showing a variation in the cross-sectional area of a blow-hole in accordance with a variation in the parameter "$\epsilon$" in the hyperbola function $r=(\epsilon\cdot K)/(1-\epsilon\cdot\cos\theta)$ determining the curve E-F of each tooth 2*a* of the female rotor 2. As shown in the graph, the rotor teeth generated by curves determined by-the hyperbola function $r=(\epsilon\cdot K)/(1-\epsilon\cdot\cos\theta)$ preferably reduce the cross-sectional area of the blow-hole by about 20% in comparison with the rotor teeth generated by circular arcs. It is also noted that the size of the blow-hole is reduced in inverse proportion to an increase in the parameter "$\epsilon$".

From the above description, it is noted that the size of the blow-hole conflicts with the minimum pressure angle of the rotor machining tool, as expressed in the graphs of FIGS. 5 and 6. When the curve E-F of each tooth of the female rotor is determined by the hyperbola function $r=(\epsilon\cdot K)/(1-\epsilon\cos\theta)$, wherein $1.1\leqq\epsilon\leqq1.15$, in consideration of the above-mentioned conflict of the size of the blow-hole with the minimum pressure angle of the rotor machining tool, it is possible to produce rotor teeth having both the minimum pressure angle of 8° and a blow-hole having a size smaller than that of rotor teeth generated by circular arcs. When the parameter "$\epsilon$" in the hyperbola function $r=(\epsilon\cdot K)/(1-\epsilon\cdot\cos\theta)$ is defined as $0.0216\cdot Rm\leqq\epsilon\leqq0.0225\cdot Rm$ which is a function of the radius "Rm" of the dedendum circle "Dm" of the male rotor, it is possible to produce the rotor teeth having both the minimum pressure angle of 8° and the blow-hole having a size smaller than that of rotor teeth generated by circular arcs. It is most preferable to set the constant K in the hyperbola function $r=(\epsilon\cdot K)/(1-\epsilon\cdot\cos\theta)$ to $0.1176\cdot Rm$, that is, $K=0.1176\cdot Rm$.

Figure 7:
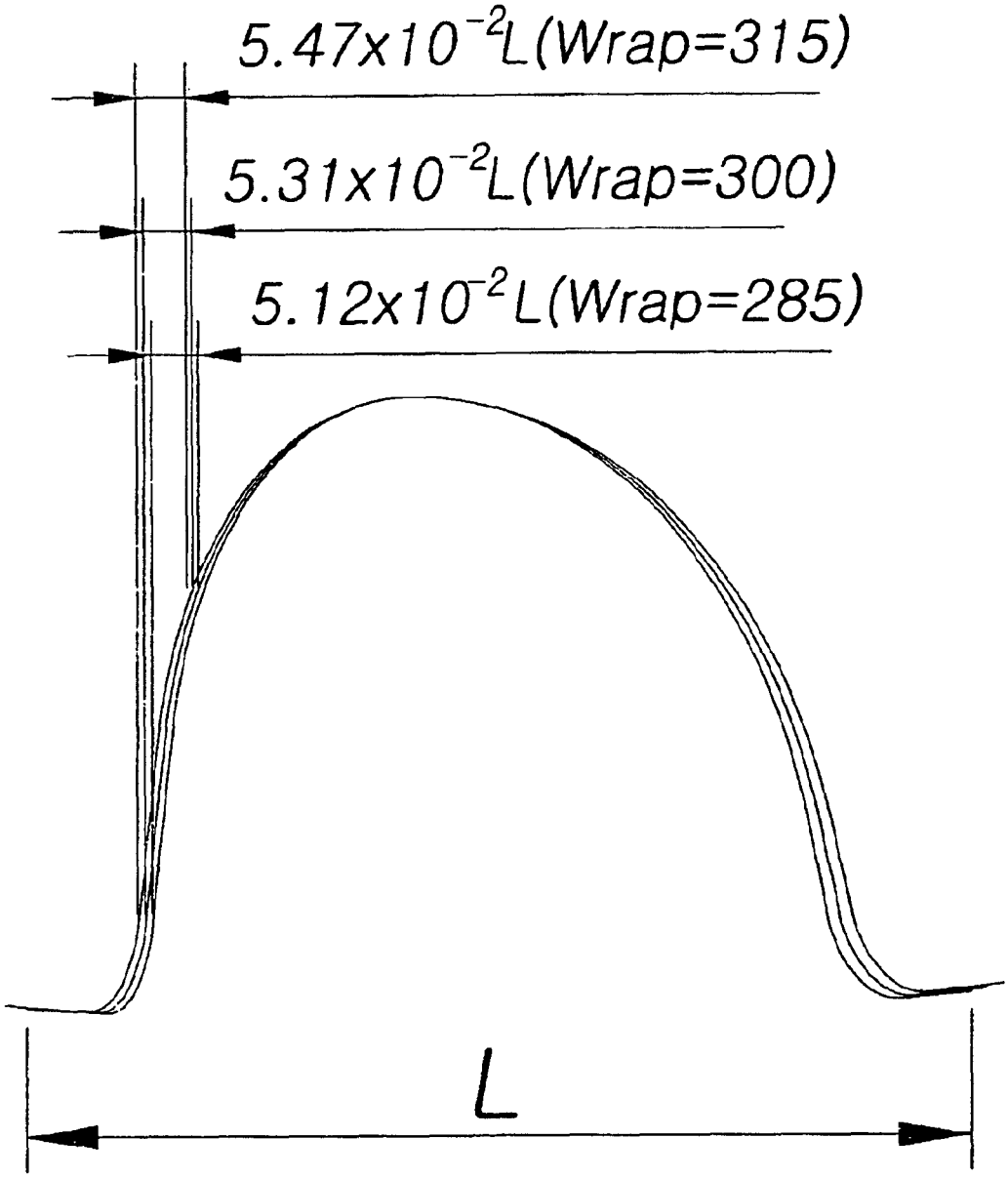
FIG. 7 is a view showing different shapes of female machining tools determined in accordance with a variation in the wrap angle of the female rotor of the present invention.

FIG. 7 is a view showing different shapes of female rotor machining tools determined in accordance with a variation in the wrap angle of the female rotor 2 of the present invention. The wrap angles of rotors for screw compressors are typically set to 300° on the basis of the male rotor. The maximum level of the wrap angles of the rotors is limited up to 360°. In addition, when the wrap angles of the rotors are set to be smaller than 300°, the size of the compressed air discharge port of a screw compressor is excessively reduced, thus increasing high discharge resistance and causing excessive power consumption. When the wrap angles of the rotors are increased to excessive levels, the thickness of rotor teeth is undesirably reduced. The strength of the rotors is degraded due to the reduced thickness of the rotor teeth. In the present invention, the wrap angle of the male rotor 2 is preferably set to be larger than 300° and not larger than 310°. When the wrap angle of the male rotor 2 is determined as described above, it is possible to obtain a rotor tooth thickness not lower than 15% of the radius of the addendum circle "Af" of the female rotor teeth, and increase the pressure angle of the rotor machining tool. The rotor profile for screw compressors according to the present invention thus somewhat increases the minimum pressure angle of the rotor machining tool while maintaining desired strength of the rotors. The pressure angle of the rotor machining tool is increased in proportion to an increase in the wrap angle of the rotors, as shown in the graph of FIG. 7. When the rotor profile for screw compressors according to the present invention is designed by using the hyperbola function $r=(\epsilon\cdot K)/(1-\epsilon\cdot\cos\theta)$ while appropriately adjusting the wrap angles of the rotors, it is possible to increase the pressure angle of the rotor machining tool by at least 3° and reduce the size of the blow-hole by at least 20%, in comparison with a conventional rotor profile generated by using circular arcs.

Figure 8:
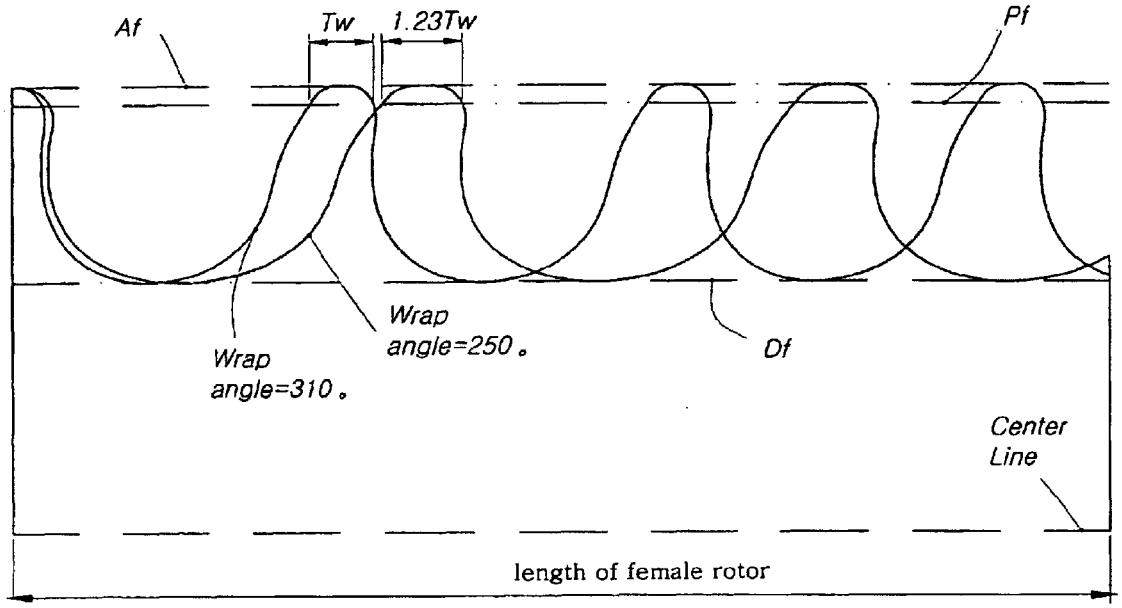
FIG. 8 is a view showing a variation in the axial thickness of each tooth of the female rotor in accordance with a variation in the wrap angle of the female rotor of the present invention.
Figure 9:
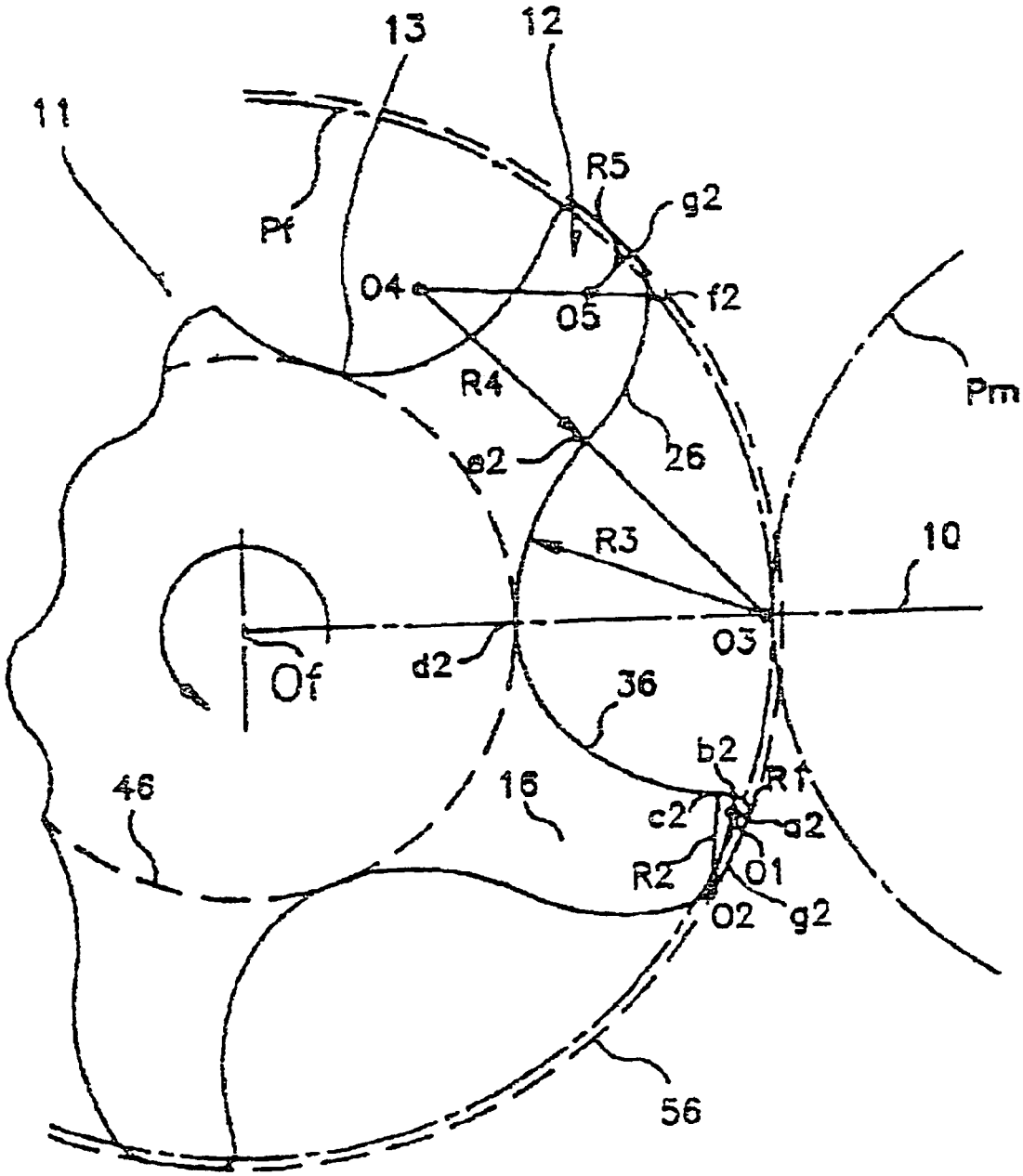
PRIOR ART FIGURE 9
FIG. 9 is a conventional rotor profile for screw compressors.

FIG. 8 is a view showing a variation in the axial thickness of each tooth of the female rotor in accordance with a variation in the wrap angle of the female rotor of the present invention. Different from FIG. 1 showing the rotor profile in a latitudinal cross-section, FIG. 8 shows the rotor profile in a longitudinal cross-section. As shown in FIG. 8, the axial thickness of each tooth of the female rotor with a wrap angle of 250° is 1.23 times as large as the axial thickness of each tooth of the female rotor with a wrap angle of 310°.

Figure 10:
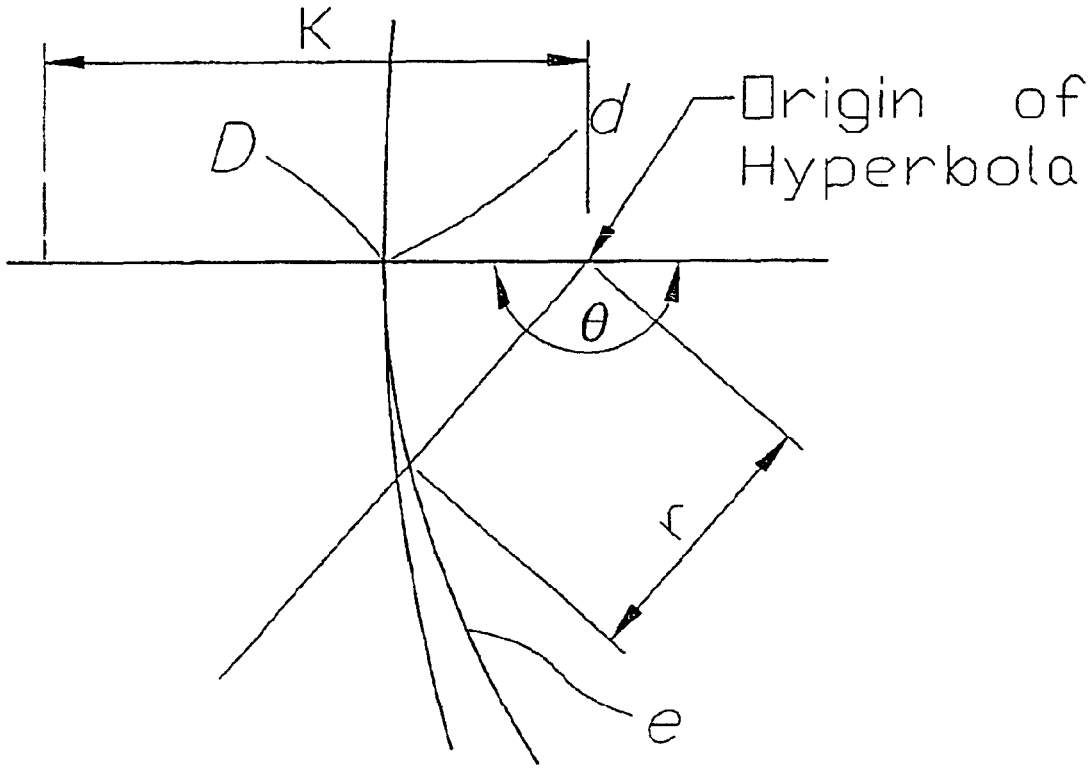
FIG. 10 is a detail view of the area indicated in FIG. 1.

FIG. 10 is a detail view of the area indicated in FIG. 1. In the hyperbola function $r=(\epsilon\cdot K)/(1-\epsilon\cdot\cos\theta)$, the angle $\theta$ can be explained as follows. Coordinate P, disclosed in U.S. Pat. No. 4,412,796, of the hyperbolic graph illustrates the values of $\theta$ and r as a function of $\theta$, since the value of r varies according to the value of $\theta$, when the values of $\epsilon$ and K are determined. When the initial value of $\theta$ is 180 degrees, it becomes the origin of the hyperbola at point d, and the value of $\theta$ diminishes progressively to form a curve in the direction of the point e, as shown in FIG. 10.

The value corresponding to the point e is determined by the necessary conditions at which a derived function of first order, in this case the slope of the hyperbola function of the curve E-F at a point e is equal to a derived function of the first order of a function of the curve D-E.

As described above, the present invention provides a rotor profile for screw compressors, wherein the male rotor has a profile with curves a-b, b-c, c-d, d-e, e-f, f-g and g-a, and the female rotor has a profile with curves A-B, B-C, C-D, D-E, E-F, F-G and G-A. Particularly due to the curve E-F of the female rotor profile, the size of a blow-hole defined between the compressor housing and the male and female rotors is preferably minimized while the pressure angle of a rotor machining tool is maintained at a level of at least 8°. Therefore, the present invention provides an improved rotor profile for screw compressors, which increases rotor machining precision, thus enhancing screw compressor performance and improving workability during a process of machining the rotors, in addition to reducing the production cost of the rotors. Furthermore, in the rotor profile of the present invention, the wrap angle of the male rotor is set to be larger than 300° and not larger than 310°, so that it is possible to increase the pressure angle of the rotor machining tool while maintaining a desired tooth thickness of the rotors.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A rotor profile for screw compressors, which is shown in a latitudinal cross-section taken along a line extending in a direction perpendicular to rotor axes and applied to male and female rotors used in a screw compressor having a housing defining an actuating space therein, the male rotor being rotatably set in the actuating space and having spiral teeth and roots defined between the teeth, and the female rotor being set in the actuating space to rotatably engage with the male rotor and having spiral teeth and roots defined between the teeth, said rotor profile comprising:

a first curve (F-G) determined as a circular arc and inscribed in an addendum circle of the female rotor at a point (G) around a trailing end of each tooth of the female rotor; and a second curve determined by a hyperbola function $r=(\epsilon \cdot K)/(1-\epsilon \cdot \cos\theta)$, wherein $1.1 \leqq \epsilon \leqq 1.15$, wherein K is a constant and $\theta$ is a variable, and a derived function of first order of the hyperbola function of the second curve at a point (F) is equal to a derived function of first order of a function of the curve (F-G).

2. The rotor profile according to claim 1, wherein said male rotor has a wrap angle larger than 300° and not larger than 310°.

3. The rotor profile according to claim 1, wherein said male rotor has a male rotor profile with curves (a-b), (b-c), (c-d), (d-e), (e-f), (f-g) and (g-a), and said female rotor has a female rotor profile with curves (A-B), (B-C), (C-D), (D-E), (E-F), (F-G) and (G-A), in which:

said curve (a-b) is a generated curve which is generated by the curve (A-B) of the female rotor;

said curve (b-c) is a generated curve which is generated by the curve (B-C) of the female rotor;

said curve (c-d) is a generated curve which is generated by the curve (C-D) of the female rotor;

said curve (d-e) is a circular arc which is inscribed in an addendum circle of the male rotor and has a center of curvature on a line extending between centers of the male and female rotors;

said curve (e-f) is a generated curve which is generated by the curve (E-F) of the female rotor;

said curve (f-g) is a generated curve which is generated by the curve (F-G) of the female rotor;

said curve (g-a) is a circular arc which is defined along a dedendum circle of the male rotor and has a center curvature at the center of the male rotor;

said curve (A-B) is a circular arc which is inscribed in the addendum circle of the female rotor at a point (A) and is circumscribed on the curve (B-C) at a point (B);

said curve (B-C) is a circular arc which is circumscribed on the curve (A-B) at the point (A) and is circumscribed on the curve (C-D) at the point (C);

said curve (C-D) is a circular arc which is circumscribed on the curve (B-C) at the point (C), and is inscribed in the addendum circle of the male rotor at a point (D), and has a center of curvature on a line extending between the centers of the male and female rotors;

said curve (D-E) is a generated curve which is generated by the curve (d-e) of the male rotor;

said curve (E-F) is a curve determined by the hyperbola function $r=(\epsilon \cdot K)/(1-\epsilon \cdot \cos\theta)$, wherein $1.1 \leqq \epsilon \leqq 1.15$, $\theta$ is a variable, a derived function of first order of the hyperbola function of the curve (E-F) at a point (E) is equal to a derived function of first order of a function of the curve (D-E), and a derived function of first order of the hyperbola function of the curve (E-F) at the point (F) is equal to the derived function of first order of the function of the curve (F-G);

said curve (F-G) is the circular arc which is inscribed in the addendum circle of the female rotor, and the derived function of the first order of the function of which at the point (F) is equal to the derived function of the first order of the hyperbola function of the curve (E-F); and said curve (G-A) is a circular arc which is defined along the addendum circle of the female rotor and has a center of curvature at the center of the female rotor.

4. The rotor profile according to claim 2, wherein said male rotor has a wrap angle larger than 300° and not larger than 310°.

* * * * *